United States Patent [19]

Pringle

[11] Patent Number: 4,722,399

[45] Date of Patent: Feb. 2, 1988

[54] SELF CLOSING EQUALIZING VALVE FOR A SUBSURFACE WELL SAFETY VALVE

[75] Inventor: Ronald E. Pringle, Houston, Tex.

[73] Assignee: Camco, Incorporated, Houston, Tex.

[21] Appl. No.: 24,957

[22] Filed: Mar. 12, 1987

[51] Int. Cl.[4] ..... E21B 34/12

[52] U.S. Cl. ..... 166/324

[58] Field of Search ..... 166/324, 321, 319

[56] References Cited

U.S. PATENT DOCUMENTS

| | | | |
|---|---|---|---|
| 4,103,744 | 8/1978 | Akkerman | 166/324 |
| 4,140,153 | 2/1979 | Deaton | 166/324 |
| 4,325,431 | 4/1982 | Akkerman | 166/117.5 |
| 4,454,913 | 6/1984 | Guidry et al. | 166/117.5 |
| 4,527,630 | 7/1985 | Pringle | 166/321 |
| 4,569,398 | 2/1986 | Pringle | 166/321 |
| 4,629,002 | 12/1986 | Pringle | 166/324 |

*Primary Examiner*—Stephen J. Novosad
*Assistant Examiner*—Bruce M. Kisliuk
*Attorney, Agent, or Firm*—Fulbright & Jaworski

[57] ABSTRACT

A hydraulically actuated subsurface safety valve for controlling fluid flow through a well tubing by actuating a first piston and cylinder assembly through a fluid passageway. A positive valve seat and valve element closes the flow of fluid to the assembly when the safety valve is opened. An equalizing valve is provided in an equalizing line and is actuated by a second piston and cylinder assembly through a fluid communication line downstream of the positive valve seat and element. A fluid bypass bypasses the second piston and cylinder assembly for bleeding off the opening pressure to the equalizing valve for allowing the equalizing valve to be biased to the closed position.

3 Claims, 6 Drawing Figures

SELF CLOSING EQUALIZING VALVE FOR A SUBSURFACE WELL SAFETY VALVE

BACKGROUND OF THE INVENTION

It is known, as disclosed in U.S. Pat. Nos. 4,325,431; 4,454,913; 4,629,002; and copending patent application Ser. No. 06/941,973 filed Dec. 15, 1986, entitled Variable Fluid Passageway for a Well Tool, to use a hydraulically actuated equalizing valve for equalizing the pressure above and below a subsurface safety valve prior to opening the safety valve. While this protects the main valve in the subsurface safety valve, the equalizing valve is subject to failure, as a result of the erosion and flow cutting, of the equalizing valve element and seat due to the high pressures and high velocities flowing through the equalizing valve.

The present invention is directed to a self-closing equalizing valve for use in a subsurface safety valve which automatically closes after the subsurface safety valve is opened and remains closed until it is needed during the next opening cycle of the subsurface safety valve. The self-closing equalizing valve reduces erosion, and provides increased life and dependability of the equalizing valve.

SUMMARY

The present invention is directed to a hydraulically actuated subsurface safety valve which is controlled by a first piston and cylinder assembly in response to fluid pressure in a fluid passageway adapted to be in communication with fluid pressure at the well surface. A positive valve seat and valve element is positioned in the fluid passageway to shut off fluid flow to the assembly when the safety valve is opened. An equalizing valve is positioned in an equalizing line and is controlled by a second piston and cylinder assembly which is in fluid communication with the fluid control passageway through a fluid communication line downstream of the positive valve seat and element. The equalizing valve opens prior to the safety valve. After the safety valve opens the positive valve and seat is closed shutting off the supply of control fluid to the equalizing valve. A bypass bleeds the opening pressure around the second piston and cylinder assembly allowing biasing means to close the equalizing valve.

The present invention is directed to a subsurface well safety valve for controlling fluid flow through a well conduit and includes a housing having a bore and a first valve closure member in the bore moving between open and closed positions for controlling fluid flow through the bore. A tubular member is telescopically movable in the housing for controlling the movement of the first valve closing member and biasing means moves the tubular member in a direction to close the valve. A first piston and cylinder assembly is positioned in the housing and moves the tubular member. A fluid control passageway is positioned in the housing in communication with the assembly and is adapted to be in communication with fluid pressure at the well surface. A valve seat and valve element are positioned in the fluid passageway and positioned to shut off flow from the fluid passageway to the assembly when the first valve closure member is opened.

An equalizing line is in communication with the inside of the housing between points below and above the first valve closure member with an equalizing valve positioned therein. A second piston and cylinder assembly in the housing is connected to the equalizing valve and is in communication with the fluid control passageway through a fluid communication line downstream of the valve seat and element for opening the equalizing valve prior to the opening of the first valve. Second biasing means are provided for moving the equalizing valve to a closed position. A fluid bypass bypasses the second piston and cylinder assembly for bleeding off opening pressure to the equalizing valve after the valve seat has seated on the valve element to allow the second biasing means to close the equalizing valve.

A still further object of the present invention is wherein the bypass passageway is in the second piston and cylinder assembly.

Yet a still further object of the present invention is wherein the second piston and cylinder assembly includes a piston moving relative to the assembly in which the piston includes oppositely directed metal sealing cups engaging the cylinder, and the bypass extends from the fluid communication line to a point between the oppositely directed metal cups.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1A:
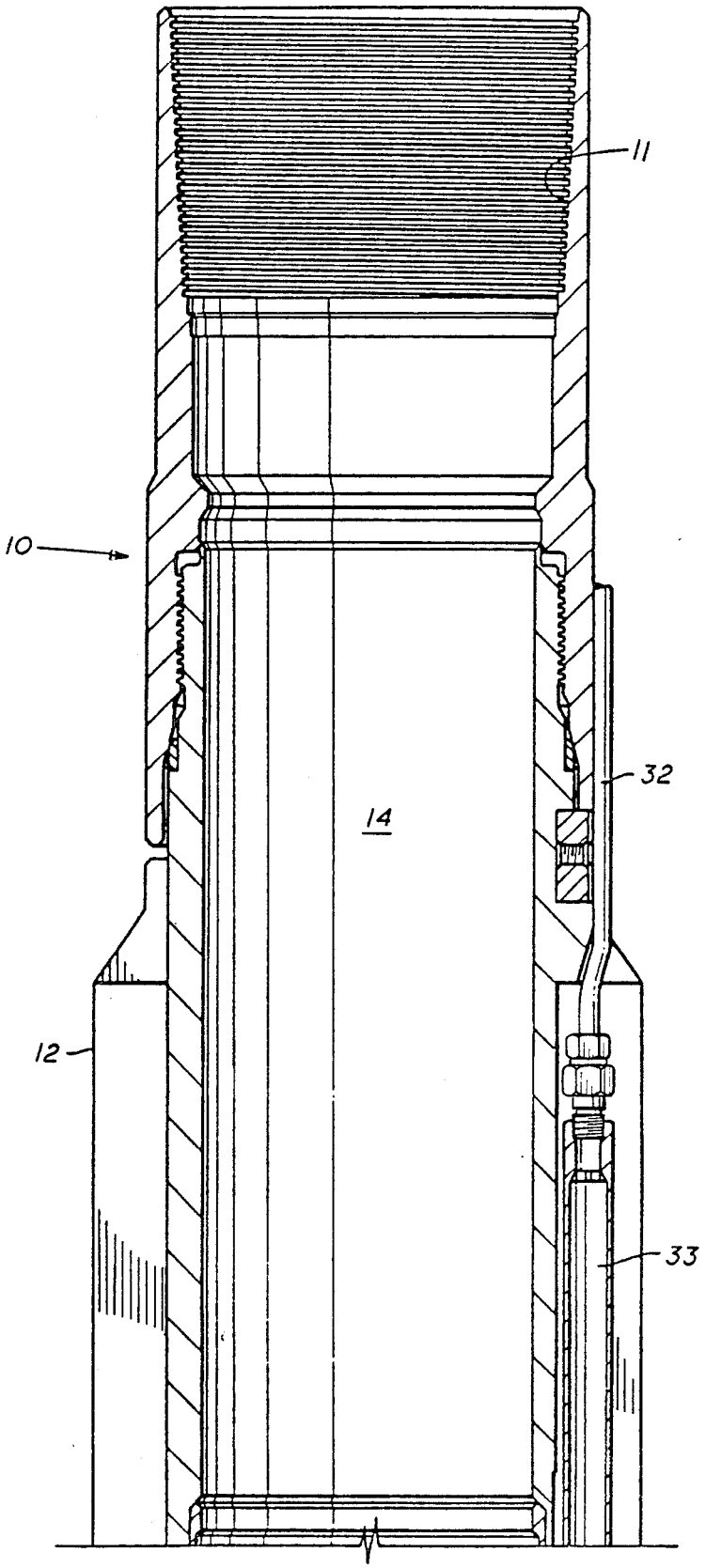
FIGS. 1A, 1B, 1C, 1D and 1E are continuations of each other and form an elevational view, in cross section, of a subsurface safety valve utilizing the present invention.

While the present improvement of a self-closing equalizing valve for use in a subsurface safety valve will be described, for purposes of illustration, as incorporated in a flapper-type tubing retrievable safety valve, it will be understood that the present self-closing equalizing valve may be used with other types of subsurface safety valves.

Referring now to the drawings, a subsurface safety valve using the present invention is generally indicated by the reference numeral 10 and is shown as being of a non-retrievable type for connection in a well conduit or tubing (not shown) such as by threaded box 11 at one end and a threaded pin 13 at the other. The safety valve 10 generally includes a body or housing 12 adapted to permit well production therethrough under normal operating conditions but in which the safety valve 10 may close or be closed in response to abnormal conditions.

Figure 1B:
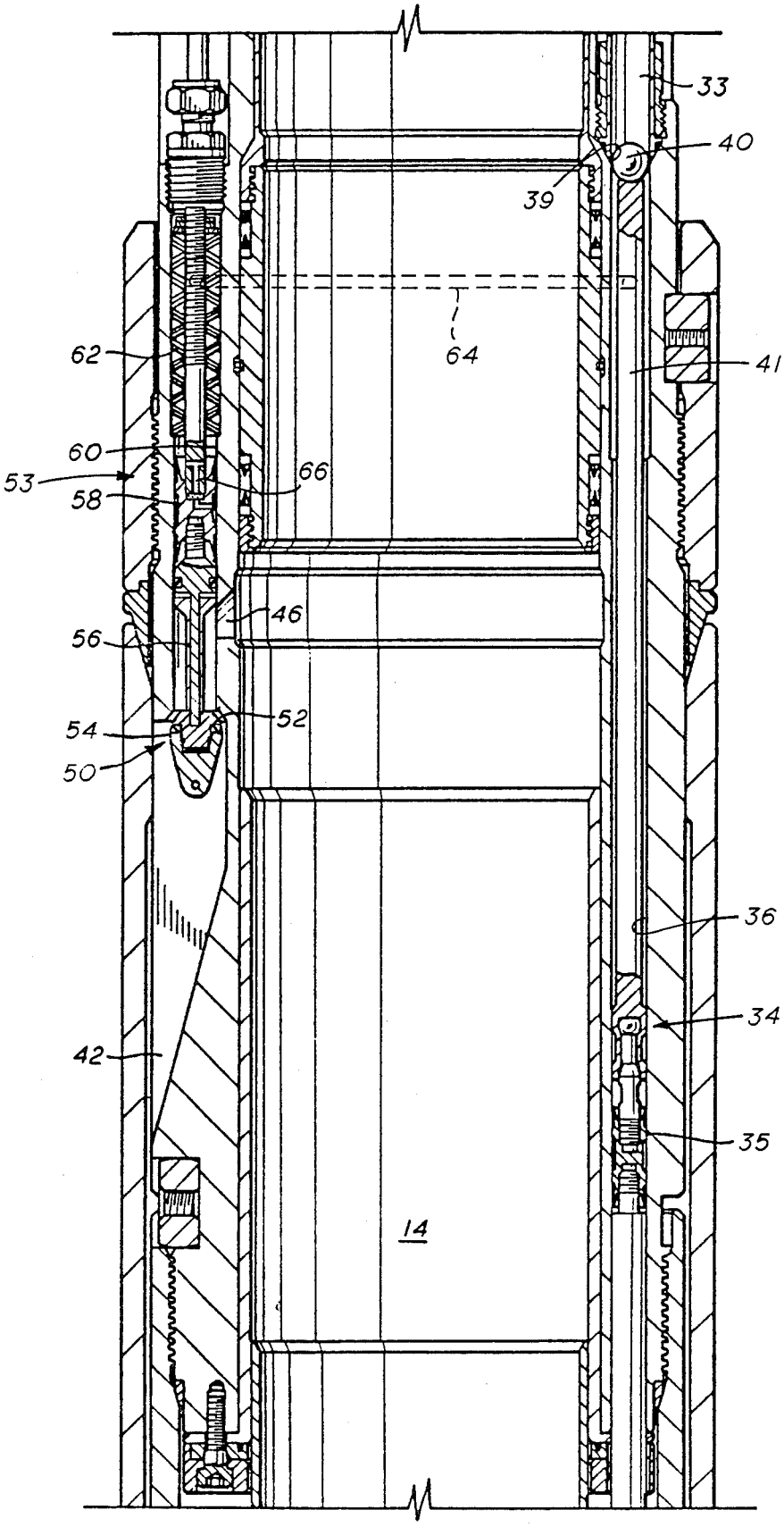
Figure 1C:
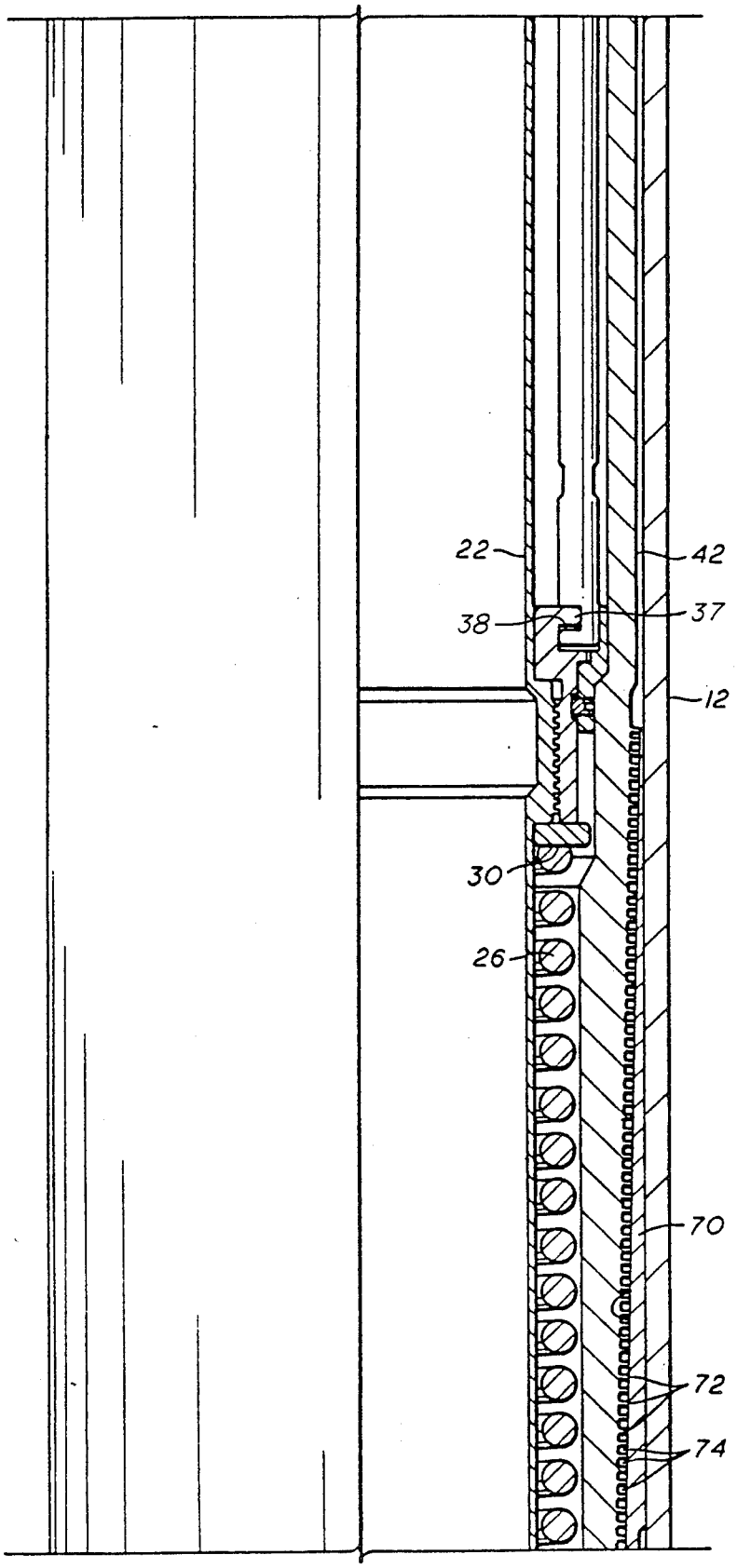
Figure 1D:
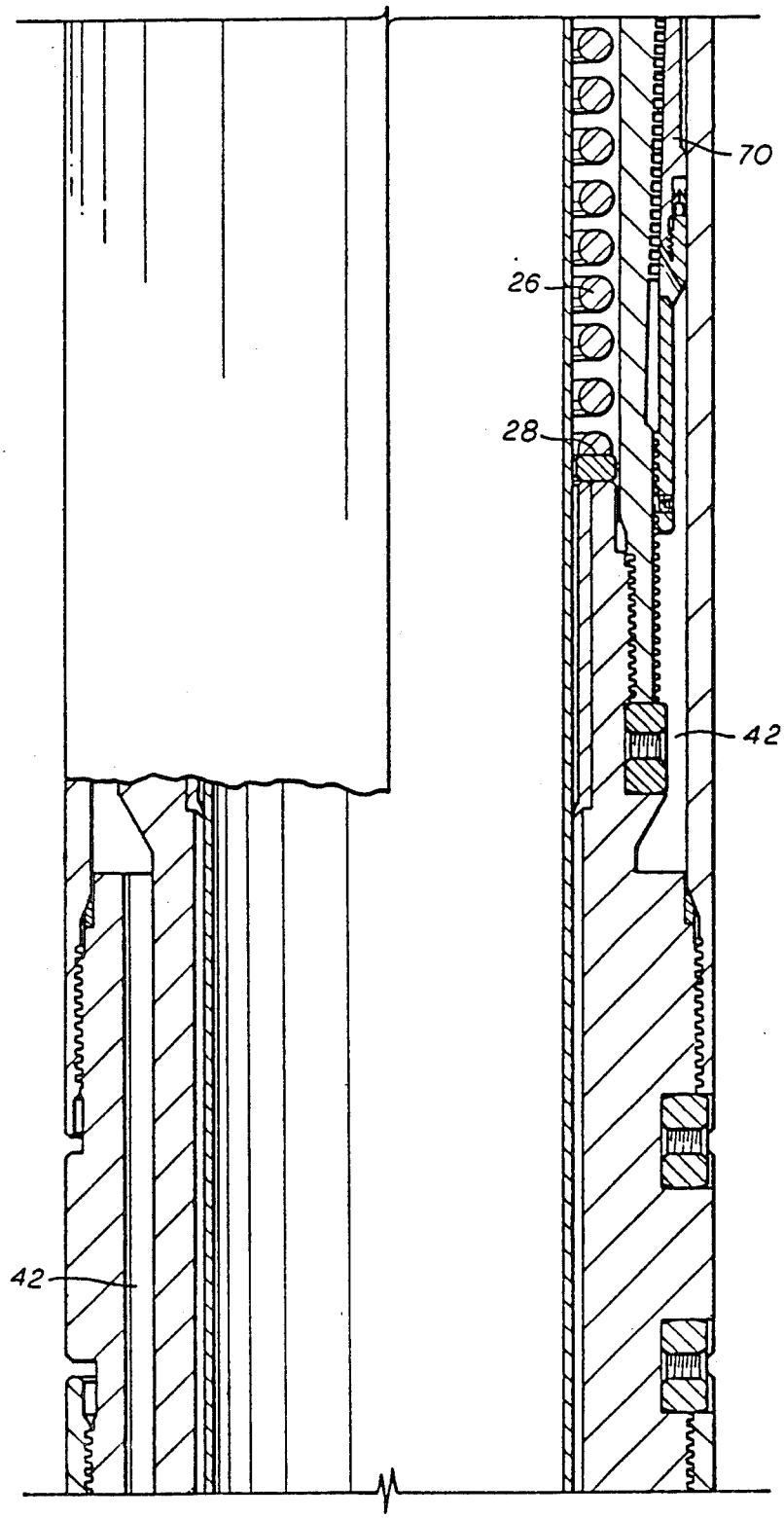
Figure 1E:
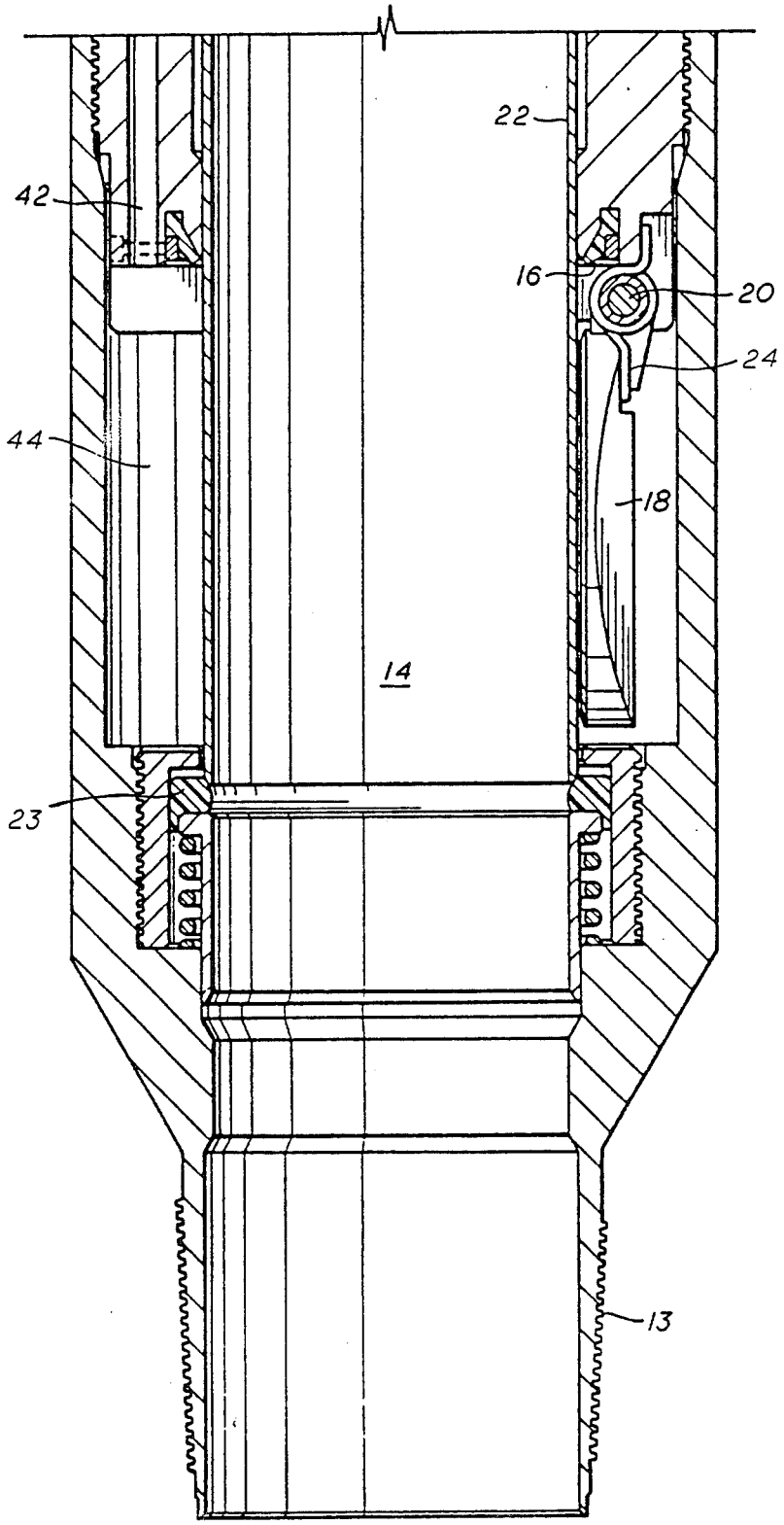

As best seen in FIG. 1E, the safety valve 10 generally includes a bore 14, an annular valve seat 16, valve closure element such as a flapper valve 18 connected to the body 12 by a pivoting pin 20. A tubular member or flow tube 22 is telescopically movable in the body 12 and through the valve seat 16. When the flow tube 22 is moved to a downward position, as shown in FIG. 1E, the tube 22 pushes the flapper 18 away from the valve seat 16. Thus the valve 10 is held in the open position so long as the flow tube 22 is in the downward position. When the flow tube 22 is moved upwardly, the flapper 18 is allowed to move upwardly on to the seat 16 by the action of a spring 24.

The safety valve is controlled by the application or removal of a pressurized fluid, such as hydraulic fluid, through a control path or line such as conduit 32 extending to the well surface which supplies a pressurized fluid to a fluid passageway 33 which is in communication with a first piston and cylinder assembly generally indicated by the reference numeral 34 consisting of a piston 35 movable relative to a cylinder 36 (FIG. 1B). One of the piston 35 and cylinder 36, such as the piston 35, is connected to the flow tube 22 such as by a tongue 37 and groove 38 (FIG. 1C) for contacting and moving the tubular member 22. When pressure is applied to the conduit 32, the piston 35 and flow tube 22 will be moved downwardly forcing the valve closure member 18 off of the seat 16 and into the full open position. If the fluid pressure in the conduit 32 is reduced sufficiently, various biasing means will urge the tube 22 upwardly beyond the seat 16 allowing the flapper 18 to close. The biasing means may include a spring 26 acting between a shoulder 28 on the valve body 12 and a shoulder 30 connected to the flow tube 22 for yieldably urging the flow tube 22 in an upward direction. The biasing means may also include pressurized fluid such as pressure of the fluid in the bore 14 flowing around the flow tube 22 and acting upon the bottom of the piston 35.

However, since the piston seals on the piston 35 may leak, it is desirable to provide a positive valve seat and valve element in the passageway 33 to limit the amount of leakage of hydraulic control fluid through the line 32. Therefore, similar to the structure shown in U.S. Pat. Nos. 4,527,630 and 4,569,398, a valve seat 39 and valve element 40 (FIG. 1B) are provided in the fluid passageway 33 which are positioned to seat and shut off fluid flow from the fluid passageway 33 to the piston and cylinder assembly 34 when the safety valve 10 is in the open position. Thus, when pressure is applied to the fluid passageway 33, the hydraulic fluid will flow around a piston rod 41 connected to the piston 35 to activate the piston 35 until the flow tube 22 opens the valve member 18 and the ball 40 seats on the valve seat 39. The ball 40 which may be connected to or separate from the piston rod 41 when, in the seated position, holds the rod 41 and safety valve in the open position. When pressure is relieved, the biasing means including the spring 30 and fluid pressure acts against the bottom of the piston 35 moving the piston rod 41 and valve element 40 and flow tube 22 upwardly closing the safety valve.

Once the valve 10 is closed with the valve closure member 18 seated on the seat 16, it is usual that there is a greater pressure in the bore 14 below the member 18 than above the member 18. This holds the valve closure member 18 seated with a high difference pressure and it is therefore desirable to equalize the pressure across the valve member 18 before reopening in order to be able to open the valve against the differential pressure and prevent the high velocities of fluid flow through the valve member 18 and the seat 16 from eroding and damaging the valve. Therefore, it is conventional to utilize an equalizing valve which is opened prior to the opening of the valve closure member 18 to equalize pressure across the member 18. However, the equalizing valve itself may fail as a result of the fluid flow erosion due to high velocity flow and/or high pressure for an extended period of time. Referring now to FIGS. 1B, 1C, 1D and 1E, one or more equalizing lines 42 and equalizing valves 50, preferably two, are provided in the housing 12 having a lower end 44 in communication with the space below the valve seat 16 and an upper end extending through a port 46 into the upper portion of the bore 14 above the valve seat 16. Thus, when the equalizing line 42 is opened, fluid may flow from below the first valve member 18 and valve seat 16 and up through the port 46 and into the bore 14 above the valve seat 16.

An equalizing valve generally indicated by the reference numeral 50 is provided in each equalizing line 42 and consists of a valve seat 52 and a valve element 54. When the valve element 54 is seated on the seat 52 the equalizing line 42 is closed. An actuating stem 56 is connected to the valve element 54 and to a second piston and cylinder assembly generally indicated by the reference numeral 53 which includes a piston 58 movable relative to a cylinder 60, one of which, such as the piston 58 is connected to the actuating stem 56. The piston and cylinder assembly 53 is exposed to a fluid communication line 64 which is connected to the fluid control passageway 33 downstream of the valve seat 39. Therefore, when the safety valve 10 is in the closed position, the valve element 40 is positioned above the seat 39 and when fluid pressure is applied to the conduit 32 the control fluid will be applied both to the first piston and cylinder assembly 34 for operating the flow tube 22 and also to the second piston and cylinder assembly 53 for operating the equalizing valve 50. However, the equalizing valve 50 is designed to operate and open the equalizing line 42 prior to the flow tube 22 engaging and moving the flapper 18 off of the seat 16. The equalizing valve 50 is biased to a closed position by biasing means such as a spring 62.

After the equalizing valve 50 equalizes the pressure across the valve member 18, the flow tube 22 moved downwardly to open the valve member 18, as best seen in FIG. 1E, and engages a seal 23 which is for the purpose of closing the lower end of the equalizing lines 42 while the safety valve is in the open position for protecting the equalizing valve 50 in this position. However, the seal 23 may wear or fail, and if the equalizing valve 50 is open and also when the safety valve is starting to close, the equalizing valve 50 will be subject to fluid flow and erosion.

Figure 2:
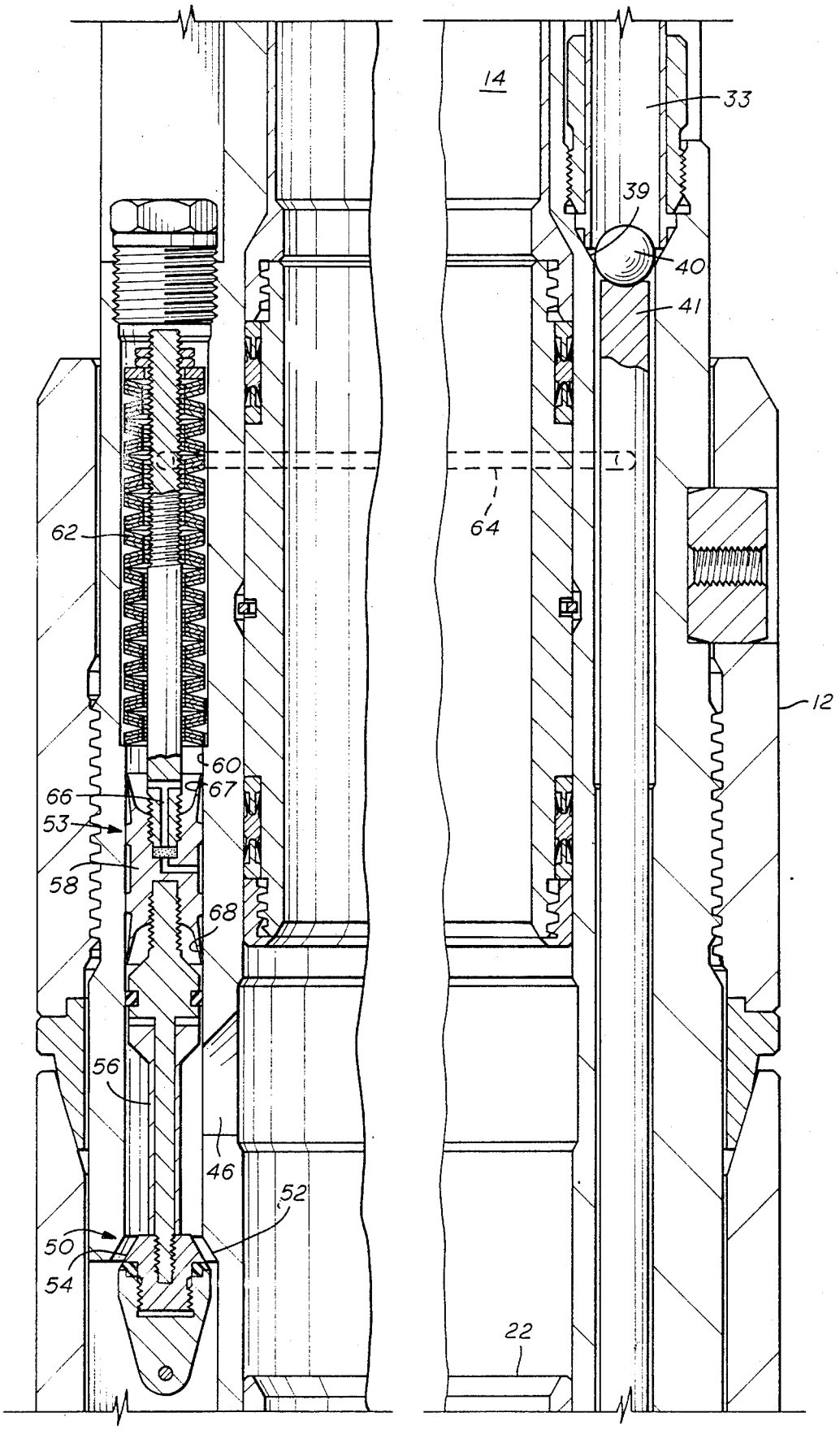
FIG. 2 is an enlarged elevational view, in cross section, of a portion of the safety valve showing the self-closing equalizing valve of the present invention.

Therefore, the present invention insures that the equalizing valve 50 will automatically close after it has performed its function of equalizing and the safety valve 10 is in the open position. Therefore, as best seen in FIGS. 1B and 2, a fluid bypass 66 is provided for bypassing the piston and cylinder assembly 53 and bleeding off the opening pressure in the line 64 after the valve element 40 has seated on the valve seat 39 thereby allowing the biasing spring 62 to close the equalizing valve 50. That is, once the safety valve 10 is open, the valve element 40 seats on the valve seat 39 blocking any further flow of hydraulic control fluid from the fluid control passageway 33 to the assembly 53. Since the equalizing valve 50 is supplied actuating fluid downstream of the valve element 40 through the communication line 64, the passage of hydraulic control fluid to the equalizing valve 50 is also stopped when the valve element 40 is seated on the seat 39. Therefore, the bleeding off of any high pressure control fluid from the communication line 64 will release the control fluid acting on the piston 50 opening the equalizing valve and allow the biasing spring 62 to close the equalizing valve.

The piston 58 may include opposing metal cup seals 67 and 68 and the fluid passageway 66 is connected between the communicating line 64 and between the cup seals 67 and 68 and will therefore flow past the cup seals 68. However, the bypass 66 may be provided in many ways. For example, the piston 58 may loosely fit into the cylinder 60 with a large clearance which would be sufficient to bleed pressure around the piston for actuating the self closing mechanism but would still provide sufficient pressure drop to be actuated by the hydraulic control fluid.

Referring now to FIGS. 1C and 1D, the equalizing line 42 may include a labyrinth passageway 70 for creating control pressure drops along the equalizing line 42 to reduce the pressure and flow velocity through the equalizing line 42 to minimize flow cutting and erosion of the equalizing valve element 54 and seat 52 thereby increasing the life of the equalizing valve. While the labyrinth passageway may be of any suitable adulatory passageway which offers resistance to fluid flow, the preferred form is an alternate series of ridges 72 and grooves 74 which extend along the equalizing line 42 and are positioned upstream of the equalizing valve 50. A fuller description of the labyrinth passageway is more fully described in copending patent application Ser. No. 941,973 which is incorporated herein by reference.

The present invention, therefore, is well adapted to carry out the objects and attain the ends and advantages mentioned as well as other inherent thereof. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A subsurface well safety valve for controlling the fluid flow through a well conduit comprising, a housing having a bore and a first valve closure member in the bore moving between open and closed positions for controlling fluid flow through the bore, a tubular member telescopically movable in the housing for controlling the movement of the first valve closure member, biasing means for moving the tubular member in a direction to close the valve, a first piston and cylinder assembly in the housing contacting and moving the tubular member, a fluid control passageway positioned in the housing in communication with the first piston and cylinder assembly and adapted to be in communication with fluid pressure at the well surface, a valve seat and valve element positioned in the fluid control passageway and positioned to shut off flow from the fluid passageway to the first piston and cylinder assembly when the first valve closure member is opened, an equalizing line in communication with the bore of the housing between points below and above the first valve closure member, an equalizing valve in the equalizing line, a second piston and cylinder assembly in the housing connected to the equalizing valve, said second piston and cylinder assembly being in fluid communication with the fluid control passageway through a fluid communication line downstream of the valve seat and element for opening the equalizing valve prior to the opening of the first valve, second biasing means for moving the equalizing valve to a closed position, and a fluid bypass for bypassing the second piston and cylinder assembly for bleeding off opening pressure to the equalizing valve after the valve seat has seated on the valve element to allow the second biasing means to close the equalizing valve.

2. The apparatus of claim 1 wherein the bypass passageway is in the second piston and cylinder assembly.

3. The apparatus of claim 1 wherein the second piston and cylinder assembly includes a piston moving relative to the cylinder in which said piston includes oppositely directed metal sealing cups engaging the cylinder, and the bypass extends from the fluid communication line to a point between the oppositely directed metal cups.

* * * * *